United States Patent [19]

Fleshman Jr.

[11] Patent Number: 4,886,471

[45] Date of Patent: Dec. 12, 1989

[54] VACUUM SEAL FOR ELECTRICAL CONNECTOR

[75] Inventor: William D. Fleshman Jr., Elizabethtown, Pa.

[73] Assignee: AMP Incorporated, Harrisburg, Pa.

[21] Appl. No.: 148,192

[22] Filed: Jan. 27, 1988

Related U.S. Application Data

[63] Continuation of Ser. No. 8,889, Jan. 30, 1987, abandoned.

[51] Int. Cl.[4] ..... H01R 13/40

[52] U.S. Cl. ..... 439/587; 439/282; 439/148

[58] Field of Search ..... 439/586–589, 439/592, 593, 273, 281–283, 41, 148, 738, 873

[56] References Cited

U.S. PATENT DOCUMENTS

| | | | |
|---|---|---|---|
| 2,785,384 | 3/1957 | Wickesser | 339/94 C |
| 3,163,692 | 12/1964 | Smith et al. | 264/249 |
| 3,182,280 | 5/1965 | Daut et al. | 339/38 |
| 3,328,744 | 6/1967 | Fiske | 339/61 |
| 3,550,064 | 12/1970 | Caller et al. | 339/94 C |
| 3,611,255 | 10/1971 | Shroyer | 439/282 |
| 3,681,739 | 8/1972 | Kornick | 339/94 C |
| 3,747,048 | 7/1973 | Johnson et al. | 339/75 R |
| 3,760,337 | 9/1973 | Johnson | 339/94 R |
| 3,794,958 | 2/1974 | Glover | 339/94 R |
| 3,824,526 | 7/1974 | Glover | 339/94 R |
| 3,842,390 | 10/1974 | Glover et al. | 339/94 R |
| 3,880,487 | 4/1975 | Goodman et al. | 439/282 |
| 3,963,295 | 6/1976 | Askman et al. | 339/60 R |
| 3,977,750 | 8/1976 | Glover et al. | 339/89 R |
| 3,994,553 | 11/1976 | Kornick | 339/211 |
| 4,417,736 | 11/1983 | Herrmann Jr. | 339/60 M |
| 4,601,528 | 7/1986 | Spier | 439/148 |
| 4,605,272 | 8/1986 | Myers et al. | 339/60 |
| 4,614,392 | 9/1986 | Moore | 439/587 |
| 4,684,189 | 8/1987 | Swaffield | 439/587 |

OTHER PUBLICATIONS

AMP Catalog 73–218, Revised 2–84, "LGH High Voltage Lead Assemblies, Connectors and Receptacles," pp. 1–5, 24, 55–56; AMP Incorporated, Harrisburg, Pennsylvania (1984).

*Primary Examiner*—P. Austin Bradley
*Attorney, Agent, or Firm*—Anton P. Ness

[57] ABSTRACT

An electrical plug connector of the quick disconnect type for high-voltage applications. The plug connector is matable with a receptacle connector having a tubular-shaped outer wall, a central cavity, and an electrical contact extending into the cavity from the base of the receptacle connector. The plug connector comprises an elastomeric, dielectric connector body which includes an inner central body portion and an integral, tubular-shaped, outer body portion spaced from and coaxially extending therealong defining an axially extending annular cavity therebetween. When the plug and receptacle connectors are mated, the tubular-shaped outer wall of the receptacle connector extends into and fills the annular cavity of the plug connector entering into an elastic gripping condition with at least said outer body portion and preferably with the inner body portion as well, forming broad outer and inner bands of air-free sealing engagement and causing air to be displaced from the annular cavity and creating a vacuum in the annular cavity. The vacuum and elastic gripping are sufficient to prevent inadvertent separation of the connectors, yet permits the connectors to be easily separated when desired by simply pulling them apart. The connector also provides an improved electrical seal by providing a voltage leakage path of increased length at the interface between the mated connectors. In one embodiment of the invention, the plug connector comprises a "dummy" connector usable as a seal plug for unused receptacle connectors and having a blind pin-receiving opening extending thereinto.

17 Claims, 2 Drawing Sheets

VACUUM SEAL FOR ELECTRICAL CONNECTOR

This application is a continuation of application Ser. No. 008,889 filed Jan. 30, 1987, now abandoned.

FIELD OF THE INVENTION

The present invention relates generally to electrical connectors and, more particularly, to electrical connectors for high-voltage applications.

BACKGROUND OF THE INVENTION

Electrical connectors are frequently used to provide electrical connection in high-voltage, low-current energy systems, e.g., in systems carrying 600 V to 15 KV at one-half ampere or less. Such connectors must operate with high reliability, often under severe environmental conditions. For example, connectors are frequently incorporated into high-voltage, electronic circuits located in hostile environments and must maintain peak performance within a broad temperature range and under diverse vaporous and gaseous conditions. In addition, because of space and weight limitations, the connectors must be as compact and lightweight as possible, consistent with providing a reliable electrical seal. In high-voltage applications in particular, an inadequate seal can result in voltage leaks at interfaces between assembled parts of the connector and between the connector and a complementary connector when the connectors are mated.

Known high-voltage electrical connector assemblies comprised a flexible plug connector matable with a rigid receptacle connector. The plug connector comprised a socket contact secured to the end of the center conductor of an electrical lead, and embedded within an elastomeric connector body or plug moled around the contact and the end of the lead. The receptacle connector comprised a rigid cylindrical-shaped member having an outer wall and a central cavity and having a pin contact extending axially into the cavity through the base of the member. To mate the connectors, the flexible plug connector was inserted into the cavity of the receptacle connector to electrically connect the contacts in the two connectors. The elastomeric body of the plug connector surrounded the mated contacts and engaged the base and the inner surface of the outer wall of the receptacle cavity to provide an electrical seal around the mated contacts. To secure the mated connectors and to maintain a reliable electrical seal around the mated contacts, a cap on the plug connector was threaded onto the outer surface of the receptacle connector after mating.

The need for a threaded cap to secure the above-described connector assembly was undesirable in that it increased manufacturing costs and was often inconvenient to the user, particularly when the connector assembly was positioned in a relatively inaccessible location, or if a multiplicity of quick connections and disconnections were desired. In addition, the voltage leakage path in the connector assembly was of somewhat limited length, increasing the risk of a voltage leak at the interface between the mated connectors.

SUMMARY OF THE INVENTION

The present invention provides an electrical plug connector for high-voltage applications which is of the quick disconnect type and which provides a reliable electrical seal having a voltage leakage path of substantially increased length when the connector is mated to a complementary receptacle connector.

In accordance with the invention, an electrical plug connector is provided which is matable with a receptacle connector which includes a tubular-shaped outer wall having inner and outer surfaces and an annular edge mating surface, a central cavity, and an electrical contact extending into the central cavity from the base of the receptacle connector. The plug connector comprises a connector body formed of an elastomeric, dielectric material having a main body portion, an inner central body portion extending forwardly therefrom, and an integral, tubular-shaped outer body portion extending forwardly from the main body portion coaxial with the central body portion and coextending a substantial length therealong, the inner and outer body portions defining an axially extending annular cavity therebetween for receiving the tubular-shaped outer wall of the receptacle connector when the plug and receptacle connectors are mated. The inside dimension of the elastomeric outer body portion is selected to be slightly less than the outside diameter of the receptacle connector outer wall, so that upon mating the receptacle connector outer wall acts against the elastomeric outer body portion thereby expanding it outwardly to conform closely therearound in an elastic gripping fit forming a broad outer band of air-free sealing engagement. Further, the inner central body portion's outer surface is slightly tapered proceeding rearwardly so that the outer dimension at the front end is slightly smaller than the inside diameter of the receptacle connector inner wall surface and the outer dimension at the rearward end is slightly larger than the receptacle's inside diameter, and the receptacle connector slightly compresses the elastomeric inner central body portion along the rearward end for an elastic gripping fit forming a broad inner band of air-free sealing engagement. When mated, the plug and receptacle connectors are in an interference fit resulting from movement axially together the elastomeric plug connector body conforms to the inner, outer and edge mating surfaces of the tubular-shaped outer wall of the receptacle connector within the tubular-shaped cavity to displace air from substantially the entire tubular-shaped cavity and establish a vacuum therein for retaining the connectors in mated condition and for providing an electrical seal at the interface between the mated connectors.

By the present invention, the gripping action of the elastomeric outer body portion and against the receptacle connector outer wall, and the vacuum established within the tubular-shaped cavity when the plug and receptacle connectors are mated, reliably retain the connectors in mated condition without requiring threaded caps or other separate fastening elements. In accordance with a presently preferred embodiment, the vacuum and gripping action necessitate approximately three pounds of pull to separate the mated connectors, an amount sufficient to prevent inadvertent separation of the connectors while, at the same time, providing the connectors with a quick disconnect capability permitting the connectors to be easily mated and separated whenever desired.

In accordance with a presently preferred embodiment, the plug connector comprises a connector bodyof silicone rubber or another elastomeric material having high dielectric stability molded around the end of an electrical lead and a socket contact which has been crimped onto the end of the center conductor of the lead. Silicone rubber having a durometer of about 50 to 70, available from Dow Corning Corporation, is particularly preferred.

In addition to providing a quick-disconnect capability, the connector of the present invention provides an improved electrical seal. In particular, when the plug and receptacle connectors are mated, the elastomeric plug body seals against both the inner and outer surfaces of the outer wall of the receptacle connector and against the annular edge mating surface of the receptacle connector, thus providing a meandering voltage leakage path of increased length between the mated connectors.

In accordance with an alternative embodiment the invention, the plug connector comprises a "dummy" connector usable as a seal plug for unused receptacle connectors in a multi-pin connector assembly. In this alternative embodiment, the central body portion of the plug connector body is molded to include an axial hole for receiving the pin contact of a receptacle connector during mating. A socket contact is not provided in the connector, nor is the body molded to the end of an electrical lead. The dummy connector, although not providing electrical connection, provides a reliable electrical and mechanical seal around the unused receptacle connector contact, thereby minimizing an otherwise unsafe condition arising from the exposed receptacle connector contact.

Further features and important advantages of the invention will become apparent hereinafter in conjunction with the following detailed description of presently preferred embodiments.

DETAILED DESCRIPTION OF THE PREFERRED EMBODIMENTS

Figure 2:
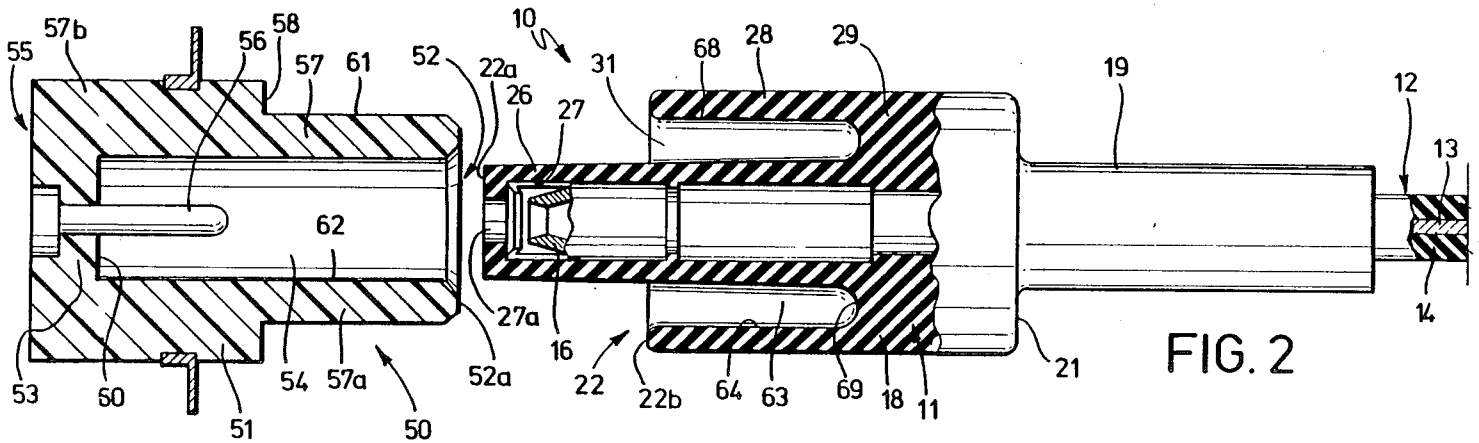
FIG. 2 is a cross-sectional view of an assembly comprising the plug connector of FIG. 1 and a complementary receptacle connector.
Figure 1:
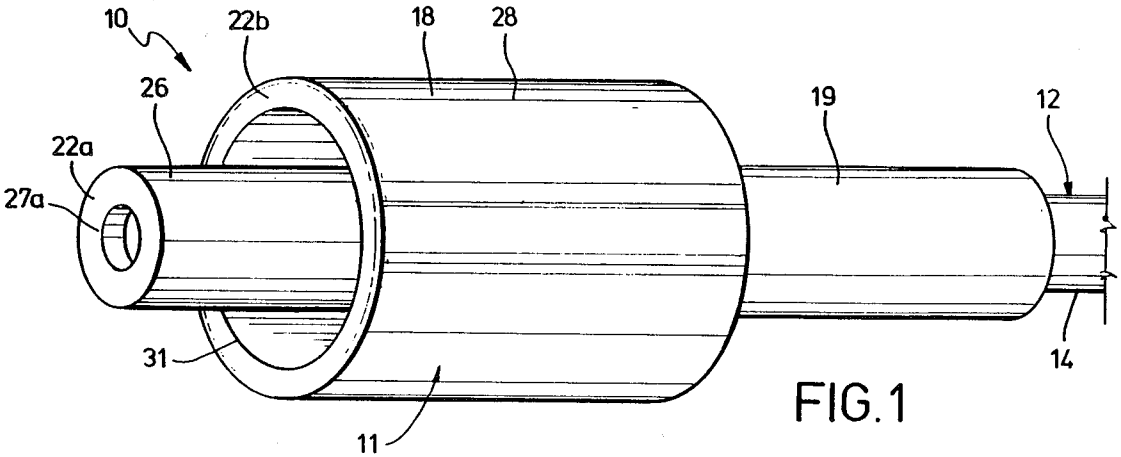
FIG. 1 is a perspective view of a plug connector according to a presently preferred embodiment of the invention.
Figure 3:
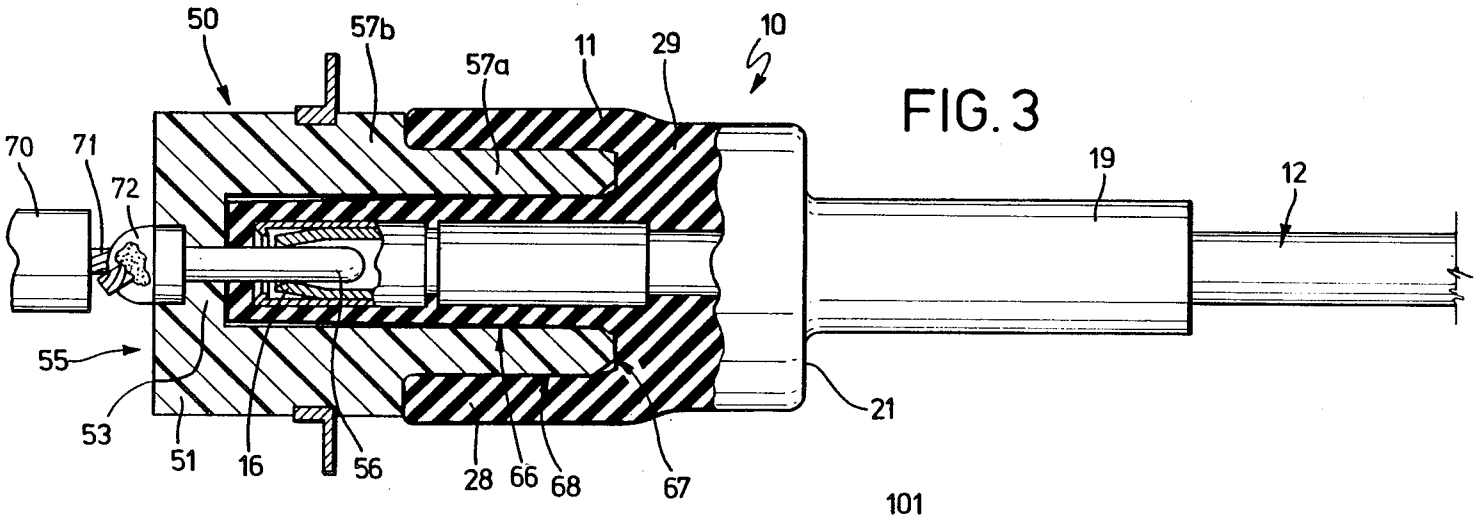
FIG. 3 is a cross-sectional view of the connector assembly of FIG. 2 in mated condition.

FIGS. 1–3 illustrate an electrical connector according to a presently preferred embodiment of the invention. The connector is generally designated by reference numeral 10 and comprises a plug connector for use in high-voltage, low-current applications, e.g., for use in energy systems which carry from about 600 V to about 15 KV at about one-half amperes or less. Connector 10 comprises a connector body 11 mounted to the end of an electrical lead 12, which, in the illustrated embodiment, comprises a center conductor wire 13 surrounded by an insulative jacket 14. Jacket 14 preferably comprises a polytetrafluoroethylene jacket (TEFLON, trademark of E. I. DuPont de Nemours & Co.) because TEFLON permits a reduction in the diameter of the lead although other suitable insulative materials can also be used if desired.

Connector 10 also includes an electrical contact 16 supported axially within connector body 11. Contact 16 comprises a socket contact and is secured to the end of center conductor wire 13 by crimping or in another manner known to those skilled in the art. Contact 16 is formed of any suitable electrically conductive material such as gold-plted bronze or nickel.

Connector body 11 is formed of an elastomeric material having high dielectric stability. Preferably, body 11 comlprises a molded member molded around contact 16 and the end of lead 12. More particularly, to manufacture connector 10, socket contact 16 is crimped to an exposed length of center conductor 13, and the end of lead 12 having the contact secured thereto is positioned in a mold. The material to form connector body 11 is then placed in the mold and the body is molded around the socket and the end of lead 12 using conventional molding procedures. The mold is configured to define a connector body 11 having a flange portion 19 surrounding the end of lead 12 and a main body portion 18. Preferably, the surface of jacket 14 to be disposed beneath flange portion 19 is provided with a roughened surface such as by etching ridges and valleys thereon to improve the bond between the flange portion 19 and jacket 14 such as by applying an etchant such as TETRA-ETCH solution (product of W. L. Gore & Associates, Inc., Flagstaff, Ariz.). Connector body 11 preferably comprises silicone rubber having a durometer of about 50 to 70, available from Dow Corning Corporation.

Main connector body portion 18 is of generally cylindrical shape and includes a base end 21 mounted to lead 12 and a mating end 22. Connector body portion 18 also includes an elongated, generally cylindrical-shaped, inner or central body portion 26 extending axially forwardly from main body portion 18, and a tubular-shaped outer body portion 28 also extending forwardly of main body portion 18 and radially spaced outwardly from central body portion 26, coaxially extending along a substantial length thereof. Outer body portion 28 has a right cylindrical smooth inner wall surface. Central body portion 26 contains an axial passageway 27 within which socket contact 16 is retained. An opening **27*a* of reduced diameter at the mating end of axial passageway 27 provides access to socket contact 16** during mating of the plug connector with a complementary receptacle connector.

Central body portion 26 and tubualr-shaped, outer body portion 28 are integral and are connected at base end 21 by a web portion 29 as best shown in FIGS. 2 and 3. Body portions 26 and 28 are separated over a substantial portion of their length and define therebetween an annular cavity 31 which extends longitudinally into main body member portion 18 from mating end 22 to web portion 29. As shown in FIGS. 1–4, central body portion 26 extends forwardly of tubular-shaped outer body portion 28. Preferably, central body portion 26 has an outer surface 63 which is slightly tapered outwardly from mating end 22 to the rearward end proximate web portion 29.

Plug connector 10 is matable with a receptacle connector of conventional type such as illustrated at 50 in FIGS. 2 and 3. Receptacle connector 50 comprises a connector body 51 formed of a relatively rigid, dielectric material such as glass-filled epoxy. Body 51 is of generally cylindrical shape and includes a tubular-shaped outer wall 57 defining a elongated central cavity 54. Cavity 54 extends into the connecftor body from mating end 52 and is closed at the back end 55 of the connector by back wall 53. A pin contact 56 is supported in back wall 53, and extends axially into cavity 54. Pin contact 56 is adapted to terminate a center conductor wire as known to those skilled in the art, such as wire 71 of cable 70 soldered to eyelet 72 of contact 56 in FIG. 3.

As best shown in FIG. 2, outer wall 57 of receptacle connector 50 includes a forward portion 57*a* of reduced outside diameter and a rearward portion 57*b* of somewhat lager outside diameter defining an external shoulder 58 therebetween. Forward portion 57*a* includes right cylindrical inner and outer surfaces of fixed diameters. In many conventional receptacle connectors, wall portion 57*a* is externally threaded for receipt of a threaded cap on the mating plug connector for securing the connectors together although a threaded surface is not necessary in the present invention.

FIG. 3 illustrates plug connector 10 mated with receptacle connector 50. With reference to FIGS. 2 and 3 when mated, central body portion 26 of plug connector 10 extends into cavity 54 of receptacle connector 50 until mating surface 22*a* of central body portion 26 abuts surface 60 of back wall 53 of the cavity. Simultaneously, pin contact 56 extends through opening 27*a* of central body portion 26 and into socket contact 16 of plug connector 10 to complete an electrical circuit through the mated connectors. Also when mated, reduced-diameter wall portion 57*a* of receptacle connector 50 extends into annular cavity 31 of plug connector 10 until annular edge mating surface 52*a* of receptacle connector 50 engages and compresses against the base 69 of cavity 31, which forms the primary electrical stress seal. Mating surface 22*b* of outer body porton 28 is at least adjacent shoulder 58 of receptacle connector 50. When mated, reduced-diameter porton 57*a* of receptacle connector 50 fully fills cavity 31 and, in fact, flexible plug connector body portion 18 slightly deforms around the wall portion 57*a* as shown in FIG. 3. Also, preferably, wall portion 57*a* slightly compresses surface 63 at the rearward end of central body portion 26.

As the front end of central body portion 26 enters receptacle cavity 56 air is forced out of cavity 54 along the slightly tapered surface 63 of central body portion 26. As wall portion 57*a* of receptacle connector 50 extends into annular cavity 31, air is forced out of cavity 31. When wall portion 57*a* is fully inserted into cavity 31, substantially all of the air in the cavity is displaced by the silicone rubber of plug connector body portion 18 to create a vacuum within annular cavity 31. Resistance to radially outward bulk deformation of outer body portion 28 and radially inward bulk defomation and/or compression of the rearward end of central body portion 26 by plug wall portion 57*a* keeps silicone rubber plug 11 in firm, uniform contact with the outer and inner surfaces 61 and 62 and with annular edge mating surface 52*a* of wall portion 57*a* to provide a reliable electrical seal around the mated contacts of the connectors. Additionally, the vacuum condition creates a suction opposing separation of the connectors 10 and 50. Such vacuum condition results also if outer surface 61 of receptacle connector 50 is threaded as on some conventional connectors. In the presently preferred embodiment, the effect of the vacuum and elastic gripping is such that it requires approximately three pounds of force to separate the mated connectors (even if receptacle connector 50 is threaded), an amount sufficient to prevent inadvertent or accidental separation of the connectors, but not so large as to prevent the connectors from being easily disconnected when desired. The plug connector of the present invention, accordingly, can be mated with a receptacle connector and the assembly reliably retained in mated condition without a threaded cap or other structure to secure the connectors to one another.

With the plug connector of the present invention, a longer voltage leakage path is provided than in known high voltage connectors. In particular, with reference to FIG. 3, a voltage leak would have to travel along interface 66 between the inner surface 62 of receptacle wall portion 57*a* and the inner surface 63 of cavity 31, around interface 67 between the base 69 of cavity 31 and annular edge mating surface 52*a*, and along interface 68 between outer surface 61 of wall portion 57*a* and outer surface 64 of cavity 31. A long meandering voltage leakage path is thus provided resulting in a significantly reduced risk of leakage than in prior connectors. The plug connector of the present invention provides a particularly good seal at interface 67 between the base 69 of annular cavity 31 and the annular edge mating surface 52*a* of the receptacle connector. This area has been a particular problem in maintaining a reliable electrical seal in prior connectors.

Two sample plug connectors of the present invention were molded to a TEFLON insulated cable which had been surface-etched, around a contact terminated to the conductor wire, and were subjected to a Dielectric Withstanding Voltage Test set forth in MIL-STD-202E, Method 301 at 25 KVDC (more than $1\frac{1}{2}$ times the rated voltage of 15 KV) for three minutes, at sea level pressure and room ambient temperature (23° C.). The connectors were each mated to a used, threaded receptacle connector of the type illustrated and wrapped in a conductive foil shield, with a voltage of 25 V applied between the center conductor and the foil. Both samples successfully completed the test, and additional voltage was applied to both sample assemblies at a rate of 500 V/sec until breakdown. One failed at the bonded flange-to-insulation interface at about 32 KVDC, and the other failed at the mating interface at 37 KVDC. Two additional like samples molded to non-etched TEFLON-insulated cable which were similarly tested failed at the flange-to-insulation interface at 22 KVDC and 27 KVDC respectively.

Figure 4:
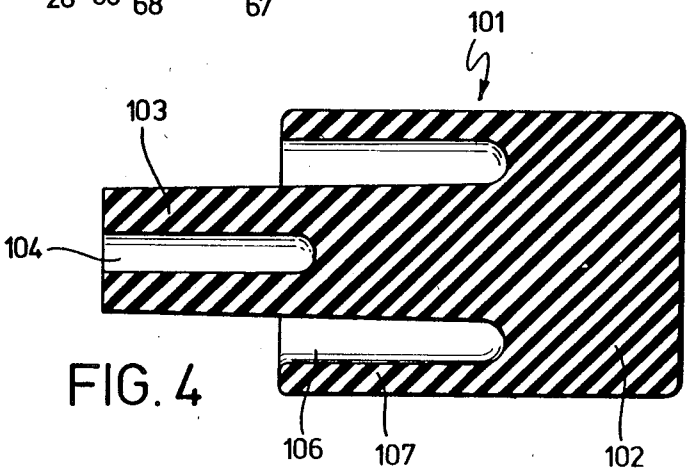
FIG. 4 illustrates a "dummy" plug connector according to an alternative embodiment of the invention.

FIG. 4 illustrates an alternative embodiment of the invention. Connector 101 comprises a dummy plug connector usable as a seal plug for unused receptacles in a multi-pin connector system. Dummy connector 101 comprises an elastomeric, dielectric connector body 102 having substantially the same external configuration as main connector body portion 18 in FIG. 1–3. Connector body 102, however, is not molded around a socket contact or around the end of an electricl lead as in the embodiment of FIGS. 1–3. Instead, central body portion 103 is provided with an axial recess 104 sized to receive the pin contact 56 (FIG. 2) of a receptacle connector when mated with the receptacle connector.

The dummy connector 101 of FIG. 4 provides a reliable electrical seal around the receptacle contact 56 (FIG. 2) to prevent voltage leaks, and an effective mechanical seal to prevent debris from entering into the unused receptacle connector; and is useful in systems which contain a plurality of receptacles mounted together, but in which fewer than all of the receptacles are actually being used at a particular time.

While what has been described constitutes presently most preferred embodiments of the invention, it should be recognized that the invention can take many other forms. Accordingly, it should be understood that the invention is to be limited only insofar as is required by the scope of the following claims.

I claim:

1. An electrical plug connector suitable for high voltage, low current applications, and matable with a receptacle connector of relatively rigid material, the receptacle connector being of the type which includes a tubular-shaped outer wall having inner and outer right cylindrical surfaces of fixed inner and outer diameters and an annular edge mating surface, an elongated central cavity, and an electrical contact extending into the central cavity from the base of the receptacle connector, said plug connector comprising:

an integral connector body formed of an elastomeric, dielectric material, said connector body including:

a main body portion;

an elongated inner central body portion extending axially forwardly from said main body portion to a forward end, and a tubular-shaped, outer body portion extending forwardly from said main body portion radially spaced from and coaxially extending along at least a substantial length of said central body portion, said inner and outer body portions defining an annular cavity therebetween extending axially forwardly from a cavity inner end at said main body portion for receiving the tubular-shaped outer wall of the receptacle connector when the plug and receptacle connectors are mated;

said outer body portion having a right cylindrical smooth inner surface along said annular cavity having an inner diameter selected to be less than the fixed outer diameter of the annular wall of the receptacle connector and necessitating radially outward bulk deformation by the annular wall during mating of the connectors, defining a broad outer band of air-free elastic sealing engagement between said smooth outer body portion inner surface and the annular wall outer surface upon full mating; and said inner body portion having a substantially right cylindrical smooth outer surface along said annular cavity having an outer diameter selected to be just greater than the fixed inner diameter of the annular wall of the receptacle connector and necessitating radially inward bulk deformation by the annular wall during mating of the connectors, defining a broad inner band of air-free elastic sealing engagement between said smooth inner body portion outer surface and the annular wall inner surface upon full mating, whereby upon axial movement of said connectors together and positioning of the edge mating surface at said cavity inner end, said inner body portion is compressed and said outer body portion is expanded forming an interference fit of said elastomeric plug connector body with said tubular-shaped outer wall of said receptacle connector substantially along the smooth walls of the entire annular cavity, to displace substantially all air from said annular cavity and establish a vacuum resistance to unmating within said annular cavity for retaining said connectors in mated condition without other latching or fastening means and for providing an electrical seal along adjacent connector surfaces at the interface between said mated connectors defining an interface essentially air-free and highly resistant to voltage leakage, while enabling deliberate unmating upon the application of sufficient axially applied unmating force.

2. The plug connector of claim 1 wherein said central body portion is slightly tapered radially outwardly from the mating end thereof to proximate said annular cavity inner end.

3. The plug connector of claim 1 wherein said electrical contact in said receptacle connector comprises a pin contact, and wherein said plug connector comprises a dummy seal plug for an unused receptacle connector, said central body portion of said plug connector including a blind axial opening extending thereinto for receiving said pin contact when said plug and receptacle connectors are mated.

4. The plug connector of claim 1 wherein said elastomeric, dielectric material comprises silicone rubber.

5. The plug connector of claim 4 wherein said silicone rubber has a durometer of from about 50 to about 70.

6. The plug connector of claim 1 and further including an electrical contact within said central body portion for being connected with said electrical contact in said receptacle connector when said plug and receptacle connectors are mated.

7. The plug connector of claim 6 wherein said contact in said plug connector is secured to the end of a center conductor wire carried within an electrical lead, and wherein said elastomeric plug body is molded around said plug connector contact and molded around and bonded to a jacketed portion of said lead.

8. The plug connector of claim 7 wherein said plug connector contact comprises a socket contact.

9. The plug connector of claim 7 wherein said electrical lead includes a jacket of polytetrafluoroethylene material surrounding said center conductor.

10. An electrical plug connector suitable for high voltage, low current applications, and matable with a receptacle connector of relatively rigid material, the receptacle connector being of the type having a tubular-shaped outer wall having inner and outer right cylindrical surfaces of fixed inner and outer diameters and an annular edge mating surface, an elongated central cavity, and an electrical contact extending into said central cavity from the base of the receptacle connector, said plug connector comprising:

an integral plug connector body formed of an elastomeric material having high dielectric stability and a durometer of about 50 to about 70, said connector body including an elongated inner, cylindrical-shaped central body portion extending axially forwardly from a main connector body portion to a forward end and containing in an axial passageway thereof an electrical contact matable with the electrical contact of the receptacle connector, and a tubular-shaped, outer body portion extending forwardly from said main connector body portion radially spaced from and coaxially extending along a substantial length of said central body portion, said inner and outer body portions defining an annular cavity therebetween extending axially forwardly from a cavity inner end at said main body portion;

said central body portion extends into said central cavity of said receptacle connector when said connectors are mated for electrically connecting said contacts in said plug and receptacle connectors, and said outer wall of the receptacle connector extends into said annular cavity in said plug connector body when said connectors are mated;

said outer body portion has a right cylindrical smooth inner surface along said annular cavity having an inner diameter selected to be less than the fixed outer diameter of the annular wall of the receptacle connector and necessitating radially outward bulk defomration by the annular wall during mating of the connectors, defining a broad outer band of air-free elastic sealing engagement between said smooth outer body portion inner surfce and the annular wall outer surface upon full mating; and said inner body portion has a substantially right cylindrical smooth outer surface along said annular cavity having an outer diameter selected to be just greater than the fixed inner diameter of the annular wall of the receptacle connector and necessitating radially inward bulk deformation by the annular wall during mating of the connectors, defining a broad inner band of air-free elastic sealing engagement between said smooth inner body portion outer surface and the annular wall inner surface upon full mating, whereby upon axial movement of said connectors together and positioning of the edge mating surface at said cavity inner end, said inner body portion is compressed and said outer body portion is expanded forming an interference fit of said elastomeric plug connector body with said receptacle connector substantially along the smooth walls of the entire annular cavity, displacing substantially all air from said annular cavity during mating to establish a vaccum resistance to unmating within said annular cavity for retaining said connectors in mated condition without other latching or fastening means and for providing a reliable electrical seal along adjacent connector surfaces at the interface of said mated connectors, defining an interface essentially air-free and highly resistant to voltage leakage while enabling deliberate unmating upon the application of sufficient axially applied unmating force.

11. The plug connector of claim 10 wherein said central body portion is slightly tapered radially outwardly from the mating end thereof to proximate said annular cavity inner end.

12. The plug connector of claim 10 wherein said elastomeric material comprises silicone rubber.

13. The plug connector of claim 12 wherein said contact in said plug connector is attached to the end of a center conductor wire carried within an electrical lead, and wherein said silicone rubber plug body is molded arounds said plug contact and molded around and bonded to a jacketed portion of said lead.

14. The plug connector of claim 13 wherein said contact in said plug connector comprises a socket contact.

15. A dummy electrical plug connector matable with a receptacle connector of relatively rigid material, the receptacle connector being of the type which includes a tubular-shaped outer wall having inner and outer right cylindrical surfaces of fixed inner and outer diameters and an annular edge mating surface, an elongated central cavity, and an electrical contact extending into said central cavity from the base of the receptacle connector, said dummy plug connector comprising:

an integral plug body formed of an elastomeric material having high dielectric stability and a durometer of about 50 to about 70, said plug connector body including an elongated inner, cylindrical-shaped central body portion extending axially forwardly from a main body portion to a forward end having a blind axial opening extending thereinto and a tubular-shaped, outer body portion extending towards said forward end from said main body portion radially spaced from and coaxially extending along a substantial length of said central body portion, said inner and outer body portions defining an annular cavity therebetween extending axially forwardly from a cavity inner end at said main body portion;

said central body portion of said plug connector extends into said central cavity of said receptacle connector when said connectors are mated for receiving said contact in said axial opening, and said outer wall of said receptacle connector extends into said annular cavity in said plug connector body when said connectors are mated;

said outer body portion has a right cylindrical smooth inner surface along said annular cavity having an inner diameter selected to be less than the fixed outer diameter of the annular wall of the receptacle connector and necessitating radially outward bulk deformation by the annular wall during mating of the connectors, defining a broad outer band of air-free elastic sealing engagement between said smooth outer body portion inner surface and the annular wall outer surface upon full mating; and said inner body portion has a substantially right cylindrical smooth outer surface along said annular cavity having an outer diameter selected to be just greater than the fixed inner diameter of the annular wall of the receptacle connector and necessitating radially inward bulk deformation by the annular wall during mating of the connectors, defining a broad inner band of air-free elastic sealing engagement between said smooth inner body portion outer surface and the annular wall inner surface upon full mating, whereby upon axial movement of said connectors together and positioning of the edge mating surface at said cavity inner end, said inner body portion is compressed and said outer body portion is expanded forming an interference fit of said elastomeric plug connector body with said receptacle connector substantially along the smooth walls of the entire annular cavity, displacing substantially all air from said annular cavity during mating to establish a vacuum resistance to unmating within said annular cavity for retaining said connectors in mated condition without other latching or fastening means and for providing a reliable electrical seal along adjacent connector surfaces at the interface of said mated connectors, defining an interface essentially air-free and highly resistant to voltage leakage.

16. The plug connector of claim 19 wherein said central body portion is slightly tapered radially outwardly from the mating end thereof to proximate said annular cavity inner end.

17. The dummy connector of claim 15 wherein said elastomeric material comprises silicone rubber.

* * * * *

UNITED STATES PATENT OFFICE

CERTIFICATE OF CORRECTION

Patent No. 4,886,471 Dated December 12, 1989

Inventor(s) William D. Fleshman Jr.

It is certified that error appears in the above-identified patent and that said Letters Patent is hereby corrected as shown below:

In the Claims:

Claim 10, Column 9, Line 9 - the word "surfce" should be --surface--.

Claim 13, Column 9, line 50, the word "arounds" should be --around--.

Claim 16, Column 10, line 59, "19" should be --15--.

Signed and Sealed this

Twenty-third Day of April, 1991

*Attest:*

*Attesting Officer*

HARRY F. MANBECK, JR.

*Commissioner of Patents and Trademarks*